US005743532A

United States Patent [19]

Lafferty

[11] Patent Number: 5,743,532

[45] Date of Patent: Apr. 28, 1998

[54] METHOD OF MAKING A SIDE BET DURING BLACKJACK

[76] Inventor: William M. Lafferty, 109 Diana Dr., Woonsocket, R.I. 02895

[21] Appl. No.: 887,436

[22] Filed: Jul. 2, 1997

[51] Int. Cl.[6] ..... A63F 1/00

[52] U.S. Cl. ..... 273/292

[58] Field of Search ..... 273/292, 274, 273/309; 463/12

[56] References Cited

U.S. PATENT DOCUMENTS

| | | | |
|---|---|---|---|
| 5,174,579 | 12/1992 | Griffiths | 273/292 |
| 5,280,915 | 1/1994 | Groussman | 273/292 |
| 5,320,356 | 6/1994 | Cauda | 273/292 |
| 5,364,105 | 11/1994 | Jones | 273/292 |
| 5,454,570 | 10/1995 | Karal | 273/292 |
| 5,538,252 | 7/1996 | Green | 273/306 |
| 5,615,888 | 4/1997 | Lofink et.al. | 273/292 |

OTHER PUBLICATIONS

Scarne's Encyclopedia of Games, Harper & Row Publishers, pp. 284–285, Dec. 1973.

*Primary Examiner*—Benjamin H. Layno

*Attorney, Agent, or Firm*—Salter & Michaelson

[57] ABSTRACT

In blackjack, a player makes an initial wager, and a dealer distributes one card to the player, one card to the dealer, another card to the player, and another card to the dealer. One of the cards to the dealer is revealed while the other is face down. The player requests additional cards until the player achieves a desired numerical value of cards less than or equal to a value of "21". When the numerical value of the player's hand is greater than "21", the game terminates, thereby resulting in the player losing the initial wager. Meanwhile, the dealer takes additional cards to achieve a desired numerical value of cards less than or equal to a value of "21" and greater than the value of the player's cards. The arrangement is such that the initial wager and a predetermined amount is awarded to the player if the player has a higher value than the dealer, or the initial wager is awarded to the dealer if the dealer has a higher value than the player. With the side bet of the present invention, after the dealer deals the cards to the player and the dealer, the player is given the opportunity to place a side bet if the dealer's revealed card has a value of "10". The player is awarded the a predetermined amount when the dealer's face down card has a value of "11" (i.e., an ace). But, if the dealer's face down card has a value other than "11", the player loses the side bet.

6 Claims, 1 Drawing Sheet

METHOD OF MAKING A SIDE BET DURING BLACKJACK

BACKGROUND OF THE INVENTION

1. Field of the Invention

The instant invention relates generally to betting-type games, and more particularly to a side bet that is made during a game of blackjack.

2. Description of Prior Art

Over the years, there have been many efforts to improve the game of blackjack. In this regard, reference can be made to U.S. Pat. Nos. 5,174,579 to Griffiths, 5,280,915 to Groussman, 5,320,356 to Cauda, 5,364,105 to Jones, 5,454,570 to Karal, 5,538,252 to Green, and 5,615,888 to Lofink et al. as representative prior art in this area.

Of these prior art references, the Karal patent discloses a method of game play that allows the player to insure against the appearance of values of cards in a dealer's hand which would defeat the numerical value of a player's hand and cause the player to lose the original wager. Reference is made to FIG. 1 of Karal which discloses a relatively complicated table felt for betting on certain combination of numbers. If the wagered on value appears, the player is paid according to predetermined odds (e.g., 10-1). Prior to the dealer revealing the down card, or even after the dealer reveals the down card, the player can make a supplemental wager that the dealer's total will achieve a predetermined number. Thus, after the dealer reveals each of his additional cards, the player wins the supplemental wager if the numerical value of the dealer's additional card corresponds to the numerical value wagered on by the player. Reference is made to an example given by Karal on column 3, lines 51–67 which states:

> [a]s a more particular example, a player has arrived at a card count of "18" and decides to stand. The dealer's revealed card is a nine corresponding to a card count of "9". At this time, the player may place a supplemental wager on the dealer drawing a face card (10 count) at 2:1 odds and/or an Ace at 10:1 odds.

Either a "10" count or an Ace's "11" count will give the dealer a card count of "19" or "20" which will defeat the player's card count. If the dealer's down card is either a 10 or an Ace, the player will win the supplemental wager but will lose the original wager. Thus, the player is able to insure against the loss of the original wager. If the down card is not a "10" or an Ace the player loses the supplemental wager. If the down card is an "8" the player will win as the dealer must stand at "17".

Thus, Karal's method of play gives the player the opportunity to continue play even after the player has busted.

However, Karal's method is disadvantageous in several respects. Mainly, the game is difficult for the player and the dealer to keep track of the various type of bets and what their respective pay outs are. This leads to confusion, and a reluctance to play the supplemental wager. There is presently a need for a simple side bet which is easy to understand and play.

SUMMARY OF THE INVENTION

The instant invention is directed to an improvement to the standard card game of blackjack. Specifically, in blackjack, a player makes an initial wager, and a dealer distributes one card to the player, one card to the dealer, one card to the player, and one card to the dealer, thereby resulting in two cards dealt to the player and two cards dealt to the dealer.

One of the cards to the dealer is revealed while the other is face down. The player requests additional cards until the player achieves a desired numerical value of cards less than or equal to a value of "21". When the numerical value of the player's hand is greater than "21", the game terminates, thereby resulting in the player losing the initial wager. Afterwards, the dealer takes additional cards to achieve a desired numerical value of cards less than or equal to a value of "21" and greater than the value of the player's cards. The arrangement is such that the initial wager and a predetermined amount is awarded to the player if the player has a higher value than the dealer, or the initial wager is awarded to the dealer if the dealer has a higher value than the player. After the dealer deals the cards to the player and the dealer, the player is given the opportunity to place a side bet if the dealer's revealed card has a value of "10". The player is awarded a predetermined amount when the dealer's face down card has a value of "11" (i.e., an ace). But, if the dealer's face down card has a value other than "11", the player loses the side bet.

Accordingly, among the objects of the instant invention are: the provision of a side bet made while playing blackjack which insures against the dealer obtaining a blackjack when the dealer revealed card has a value of "10"; the provision of such an improved side bet which increases the opportunities for the player to offset the loss when the dealer obtains a winning hand; the provision of such an improved side bet which increases the amount of wagering during the game of blackjack; and the provision of such an improved side bet which is simple to understand and easy to play.

Other objects, features and advantages of the invention shall become apparent as the description thereof proceeds when considered in connection with the accompanying illustrative drawing.

BRIEF DESCRIPTION OF THE DRAWING

In the drawing, which illustrates the best mode presently contemplated for carrying out the present invention, there is shown a top plan view of a table felt used while playing blackjack, the table felt having indicia provided thereon for making a side bet of the present invention.

DETAILED DESCRIPTION OF THE PREFERRED EMBODIMENT

Figure 1:
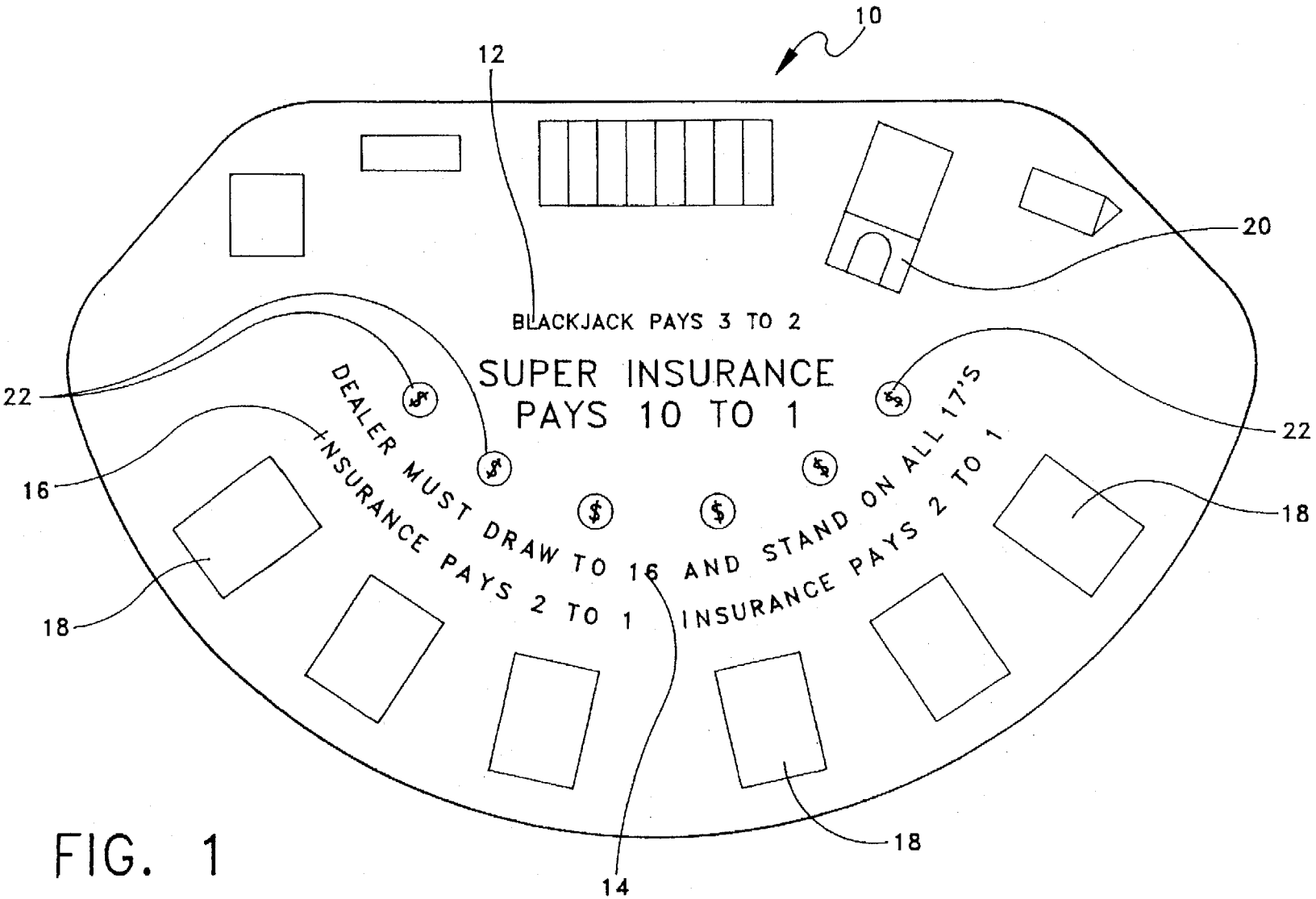

Referring now to the drawing, there is generally indicated at 10 a table felt that is used while playing blackjack according to the principles of the present invention. As shown, the table felt 10 has a layout of indicia imprinted thereon that is substantially similar to the layout of a standard blackjack table felt. More particularly, the table felt 10 has written indicia 12, 14 and 16 which spells out some of the basic rules of blackjack, such that "blackjack pays 3 to 2", "dealer must draw to 16 and stand on all 17's", and "insurance pays 2 to 1", respectively. Also, rectangular indicia 18 is provided on the table felt 10 for designating where each player places a wager and where the cards of each player are to be dealt. A card rack 20 is disposed on the table felt 10 for containing the cards used to play blackjack. The specific rules of blackjack pertinent to the present invention will be discussed in greater detail below as the detailed description of the invention proceeds.

A typical game of blackjack is played as follows. Players are seated in front of their respective indicia 18, each player placing an initial wager at his or her indicia. By placing the wager, the player is betting that he or she will achieve a card count value of "21" or a value closer to "21" than the card count value of the dealer's hand. The dealer next deals one card to the player, one card to the dealer, one more card to the player, and one mare card to the dealer, thereby resulting in two cards to the player and two cards to the dealer. Both of the cards to the player are face up whereas one of the cards to the dealer (the first) is revealed or face up and the second card is face down.

Next, the player may draw additional cards from the dealer in order to attempt to beat the anticipated count of the dealer's hand or to achieve a card count of "21". If the player's card count exceeds "21", the game terminates for that player, thereby resulting in the player losing the initial wager. After all of the players stand on a certain card count, the dealer stands or may draw additional cards based on predetermined rules. For example, if the dealer has less than "17", the dealer must draw an additional card. If the dealer has "17" or more, he or she must stand. The closest of the players and dealer to a "21" without going over wins. Thus, if a player has a card count exceeding that of the dealer, that player wins. However, if his or her card count is less than the dealer's card count, that player loses. Ties between players and the dealers are "pushed" to the next dealt hand.

One well known side bet is that of an "insurance" bet. Basically, each player has the opportunity to place an insurance bet when the dealer's revealed card is an ace (or "11"). The insurance bet is made after each player and the dealer receive their first two cards and before any additional cards are dealt to the player. Typically, when the dealer's revealed card is an ace, each player can wager one-half of the amount of his original wager as insurance against the dealer having a blackjack (a two-card "21" count). If the player makes such an insurance bet, and the dealer is dealt a blackjack, while the player loses his or her original wager, he or she wins the insurance bet (except in the case where the player also has a blackjack and there is a "push"). Typically, insurance bets pay off at two to one odds.

The typical insurance bet has proven beneficial to casinos. The odds on having blackjack when the dealer's revealed card is an ace is four in thirteen, or 30.76 percent. The odds of not having blackjack are nine in thirteen, or 69.23 percent. The casino or house advantage is 7.69 percent. Studies have shown that only one out of every ten to fifteen players takes advantage of insurance bets. Thus, for example, if a casino has 100 tables with an average 25 percent occupancy, that would mean thirty players per hour are placing insurance bets. If the average bet is $25, and there is $375 per hour wagered on insurance, the house profit is approximately $28 per hour, or $251,888 per year.

The side bet of the present invention is calculated to reap larger amounts of profit for a typical casino. The side bet is also made prior to any additional cards being dealt to the player; however, instead of requiring an ace or "11" being shown, in order to make the new side bet, the dealer's revealed card must have a value of "10" (i.e., either a king, queen, jack or ten). When the dealer's revealed card has a "10" count, the player may place the side bet on indicia 22 embodying a dollar sign ($) disposed within a circle which is further provided on the table felt 10. The side bet is relatively simple, if the dealer's face down card has a value of "11" (i.e., an ace), that player loses his or her original bet but wins the side bet (unless the player also has a blackjack, and there is a "push"). The player thus is awarded a predetermined amount. Typically, the predetermined amount is between 9 to 1 and 11 to 1 the amount of the original bet. Preferably, the predetermined amount is 10 to 1 the amount of the original bet. Thus, for a $2 bet, the player wins $20.

It has been discovered that the dealer having a revealed card with a value of "10" occurs eight times an hour. The odds that the dealer's face down card is an ace is one in thirteen, or 7.69 percent. The dealer will not have an ace in the hole twelve in thirteen, or 92.31 percent. Thus, the house advantage is two in thirteen, or 15.38 percent. Using the same statistics for a typical insurance bet, this results in a house profit of approximately $461.40 per hour, or $4,030,790 per year.

Accordingly, it can be seen that the instant invention provides a unique and novel side bet which is fun to play and beneficial to the gaming establishment. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a method of playing blackjack wherein a player makes an initial wager, a dealer distributes two cards to the player and two cards to the dealer, one of the cards to the dealer being revealed and the other being face down, the player requests additional cards until the player achieves a desired numerical value of cards less than or equal to a value of "21", the game terminating when the numerical value is greater than "21" thereby resulting in the player losing the initial wager, the dealer takes additional cards to achieve a desired numerical value of cards less than or equal to a value of "21" and greater than the value of the player's cards or greater than or equal to "17", and the initial wager and a predetermined amount is awarded to the player or the initial wager is awarded to the dealer according to a compared numerical value of the dealer's cards versus the player's cards;

wherein the improvement to the method comprises the steps of, prior to the player requesting additional cards, the player being given the opportunity to place a side bet only if the dealer's revealed card has a value of "10", the player being awarded a predetermined amount when the dealer's face down card has a value of "11", the player losing the side bet when the dealer's face down card has a value other than "11 ".

2. In the method of claim 1, the predetermined amount of the side bet being between 9 to 1 and 11 to 1 of the original side bet.

3. In the method of claim 1, the predetermined amount of the side bet being 10 to 1 of the original side bet.

4. A method of playing blackjack comprising the steps of:

(a) a player making an initial wager;

(b) a dealer distributing two cards to the player and two cards to the dealer, one of the cards to the dealer being revealed and the other being face down;

(c) prior to the player requesting additional cards, the player being given the opportunity to place a side bet only if the dealer's revealed card has a value of "10";

(d) the player requesting additional cards until the player achieves a desired numerical value of cards less than or equal to a value of "21", the game terminating when the numerical value is greater than "21" thereby resulting in the player losing the initial wager;

(e) the dealer taking additional cards to achieve a desired numerical value of cards less than or equal to a value of "21" and greater than the value of the player's cards or greater than or equal to "17";

(f) awarding the initial wager and a predetermined amount to the player or the initial wager to the dealer according to a compared numerical value of the dealer's cards versus the player's cards; and (g) awarding the player a predetermined amount when the dealer's face down card has a value of "11", the player losing the side bet when the dealer's face down card has a value other than "11".

5. In the method of claim 4, the predetermined amount of the side bet being between 9 to 1 and 11 to 1 of the original side bet.

6. In the method of claim 4, the predetermined amount of the side bet being 10 to 1 of the original side bet.

* * * * *